US005875659A

United States Patent [19]

Nosse

[11] Patent Number: 5,875,659

[45] Date of Patent: Mar. 2, 1999

[54] PADLOCK WEATHER SHIELD

[76] Inventor: Gary J. Nosse, 18217 Township Rd. 118, Pleasant City, Ohio 43772

[21] Appl. No.: 49,006

[22] Filed: Mar. 27, 1998

Related U.S. Application Data

[60] Provisional application No. 60/044,544 Apr. 23, 1997.

[51] Int. Cl.[6] ..... E05B 67/38

[52] U.S. Cl. ..... 70/56; 70/DIG. 43; 70/DIG. 56; 206/462; 206/469; 206/470

[58] Field of Search ..... 70/54–56, 417, 70/DIG. 43, DIG. 56; 206/462, 469, 470

[56] References Cited

U.S. PATENT DOCUMENTS

| | | | |
|---|---|---|---|
| 547,550 | 10/1895 | Hopkins . | |
| 676,001 | 6/1901 | Jarvis | 70/DIG. 56 X |
| 1,244,404 | 10/1917 | Ankovitz . | |
| 1,248,293 | 11/1917 | Ellington . | |
| 1,581,953 | 4/1926 | Jackson . | |
| 3,061,091 | 10/1962 | Wichman | 206/462 |
| 3,289,830 | 12/1966 | Foote | 206/462 X |
| 3,428,171 | 2/1969 | Blish | 206/469 |
| 3,916,654 | 11/1975 | Mudge, Jr. | 70/56 |
| 4,033,155 | 7/1977 | DeLucia | 70/56 |
| 4,033,156 | 7/1977 | Cottingham | 70/56 |
| 4,308,986 | 1/1982 | Parrilli | 206/470 |
| 4,687,129 | 8/1987 | Cugley | 206/470 X |
| 5,003,795 | 4/1991 | Hoke | 70/55 |
| 5,218,846 | 6/1993 | Cook et al. | 70/56 |
| 5,275,028 | 1/1994 | Gairrante | 70/56 |
| 5,638,707 | 6/1997 | Gould | 70/56 |

FOREIGN PATENT DOCUMENTS

| | | |
|---|---|---|
| 214138 | 12/1907 | Germany . |
| 327538 | 4/1919 | Germany . |
| 338405 | 8/1920 | Germany . |

OTHER PUBLICATIONS

Popular Science, aug. 1960, p. 159, "Rubber shields keep locks dry".

*Primary Examiner*—Lloyd A. Gall
*Attorney, Agent, or Firm*—Richard C. Litman

[57] ABSTRACT

A padlock weather shield comprising a preformed sheet of weather resistant material for fully covering and protecting a lock from exposure to weather related conditions such as precipitation. The shield is a patterned sheet member which bends or folds to form a box having front, side and rear panels and a curvilinear and convex roof. In one embodiment, the rear of the patterned shield has a slit to fit over a door handle. In a second embodiment, the rear has a pair of tabs and a slit to snap fit over a staple, the hasp securely anchoring the padlock weather shield in place when installed onto the staple. The roof is convex to allow precipitation and moisture to drain off of the top of the shield and down the box, and acts as a living hinge, permitting the box to be raised to access the protected lock.

10 Claims, 5 Drawing Sheets

PADLOCK WEATHER SHIELD

CROSS-REFERENCE TO RELATED APPLICATION

This application claims the benefit of U.S. Provisional patent application Ser. No. 60/044,544, filed Apr. 23, 1997.

BACKGROUND OF THE INVENTION

1. Field of the Invention

The present invention relates to devices for protecting locks from exposure to weather related phenomenon, such as precipitation, that would otherwise harm the lock.

2. Description of Prior Art

A wide variety of locks are used in outdoor locations or other places where the lock will be exposed to weather elements, such as precipitation, that are harmful to the lock. Water invading a lock through a keyhole, or through a shackle interface with a padlock body, can significantly harm the life and performance of the lock. A metal lock often rusts or corrodes after being exposed to water. After the lock rusts or corrodes, a key may no longer fit properly into a lock keyhole, or a key may not turn the lock so as to open. Also, a shackle may not slip off its lock interface once internal rusting or corrosion has taken place. Further, when a lock is exposed to freezing temperatures after being invaded by a liquid such as water, the lock generally freezes shut so that it cannot be opened until its temperature rises past freezing. Sometimes a lock will never open or work properly again after such damaging exposure.

One widely used type of device uses a padlock for securing two relatively movable members, such as doors, when closed. The device consists of a hasp, a portion of which is permanently secured to one of the relatively movable members, and a staple permanently attached to the other relatively movable member such that the staple slidably inserts through a slot in an unsecured portion of the hasp when the movable members are closed upon one another. The padlock is secured through the staple when the staple is mated with the hasp. In addition to the harm described above which affects the padlock, a metal hasp would be susceptible to similar damage due to rust or corrosion. Thus, there is a need for a device that will protect a lock, a hasp, or a staple from exposure to the elements, and particularly from exposure to moisture.

Devices designed to protect a lock have been patented in the past. For example, the following U.S. Patents all show devices that in some way cover or protect a lock: U.S. Pat. No. 547,550, issued to Parazette Hopkins on Oct. 8, 1895; U.S. Pat. No. 1,244,404, issued to Louis B. Ankovitz on Oct. 23, 1917; U.S. Pat. No. 1,248,293, issued to Thomas H. Ellington on Nov. 27, 1917; U.S. Pat. No. 1,581,953, issued to Arthur C. Jackson on Apr. 20, 1926; U.S. Pat. No. 3,916,654, issued to Karl E. Mudge, Jr. on Nov. 4, 1975; U.S. Pat. No. 4,033,155, issued to Jerry S. DeLucia on Jul. 5, 1977; and U.S. Pat. No. 5,003,795, issued to A. Chyril Hoke on Apr. 2, 1991. German Patent Document Nos. 214,138, published on Dec. 22, 1907; 327,538, published on Apr. 8, 1919; and 338,405, published on Aug. 28, 1920 also show devices that cover or protect a lock. Some of these devices also protect a hasp and staple.

Many known devices for protecting a lock fail to completely cover the lock. Because puddles can form below a lock and splash up during a heavy rain shower, or, because raindrops often blow horizontally or at an angle during a rain storm, there is a need for a device that will protect all sides of a lock from exposure to the elements.

Moreover, some outdoor locks are semi-permanently installed and frequent access to the space they secure is not needed. Because many known devices for protecting and covering a lock are inconvenient to remove and replace, there is a need for a device that will protect a lock from exposure to the elements, yet permit easy and convenient access to both the lock and the space secured by the lock.

None of the above inventions and patents, taken either singularly or in combination, is seen to describe the instant invention as claimed. Thus a padlock weather shield solving the aforementioned problems is desired.

SUMMARY OF THE INVENTION

The invention is a padlock weather shield comprising a preformed sheet of weather resistant material for fully covering and protecting a lock from exposure to weather related conditions such as precipitation. The shield is a patterned sheet member which bends or folds to form a box having front, side and rear panels and a curvilinear and convex roof. In one embodiment, the rear of the patterned shield has a slit to fit over a door handle. In a second embodiment, the rear has a pair of tabs and a slit to snap fit over a staple, the hasp securely anchoring the padlock weather shield in place when installed onto the staple.

The roof is convex to allow precipitation and moisture to drain off of the top of the shield and down the box. The front panel includes two folded tabs which form left and right sides. In one embodiment the bottom of the shield is open to the bottom side. In another embodiment, a bottom is formed from another panel or tab attached to the front panel.

By virtue of the roof, the sides and bottom of the shield are flexibly bridged to the rear panel, and therefore rest snugly against the rear panel. Thus, the entire front assembly may be lifted and rotated upwards, the roof flexing, affording easy access to the lock and hasp or handle underneath and to the space secured by the lock and hasp or handle. In all embodiments an open breathing space is provided above the sides and underneath.

The padlock weather shield is made of a clear or colored flexible sheet material. The material can be either precut and pre-molded, or precut and folded by hand during or prior to installation.

Accordingly, it is a principal object of the invention to completely cover and protect a lock from exposure to weather related elements, particularly precipitation and moisture, yet permit easy and convenient access to the lock and to the space secured by the lock.

It is an object of the invention to provide improved elements and arrangements thereof in a padlock weather shield for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
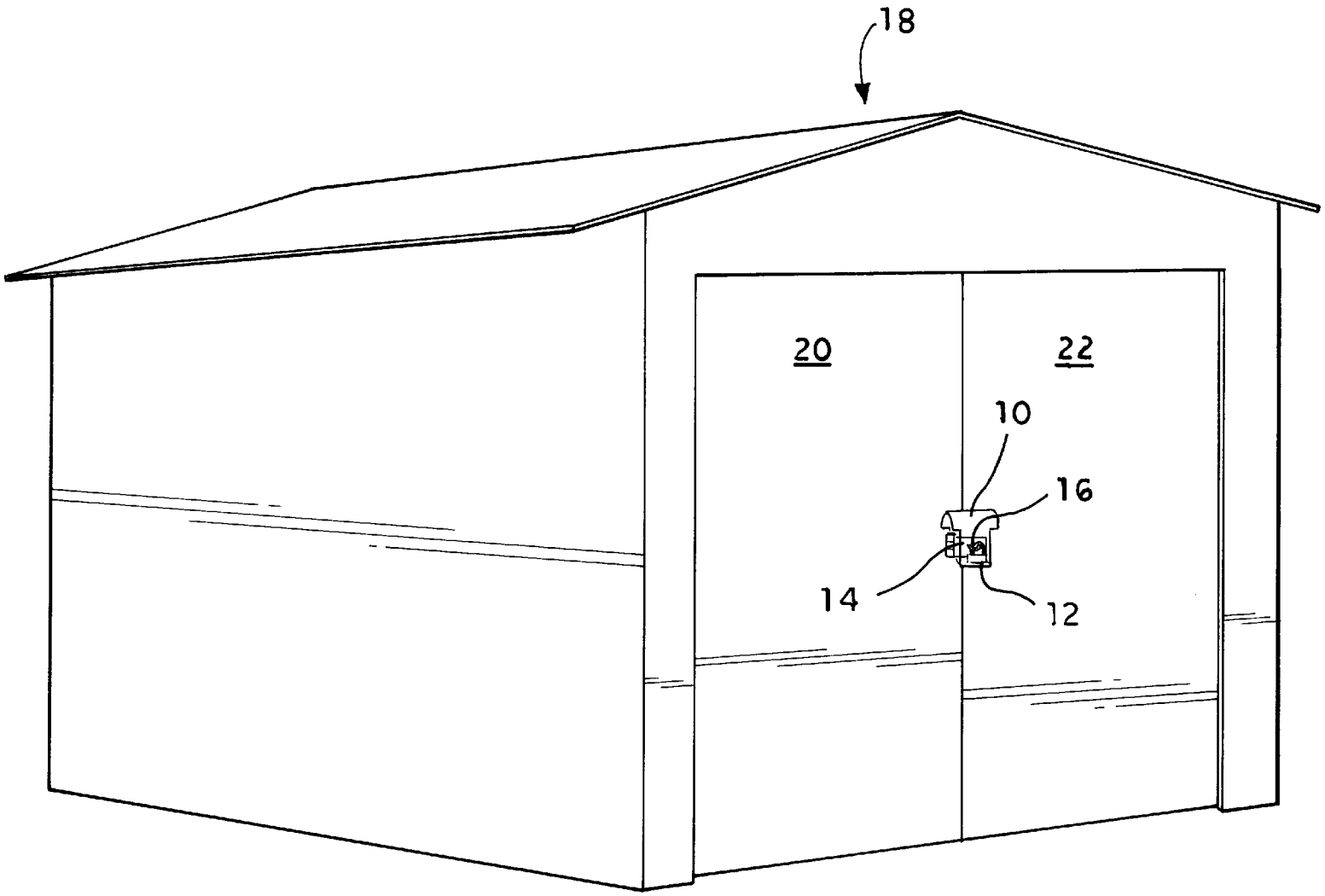
FIG. 1 is an environmental, perspective view of a clear padlock weather shield installed on an outdoor shed with a hasp and staple installation.

The present invention is a padlock weather shield designed to protect outdoor locks from damage due to exposure to weather related elements such as rain, ice, snow, and other forms of precipitation. FIG. 1 shows an embodiment of a shield 10 installed over a padlock 12 that is securing a hasp 14 over a staple 16 on an outdoor shed 18.

Figure 2:
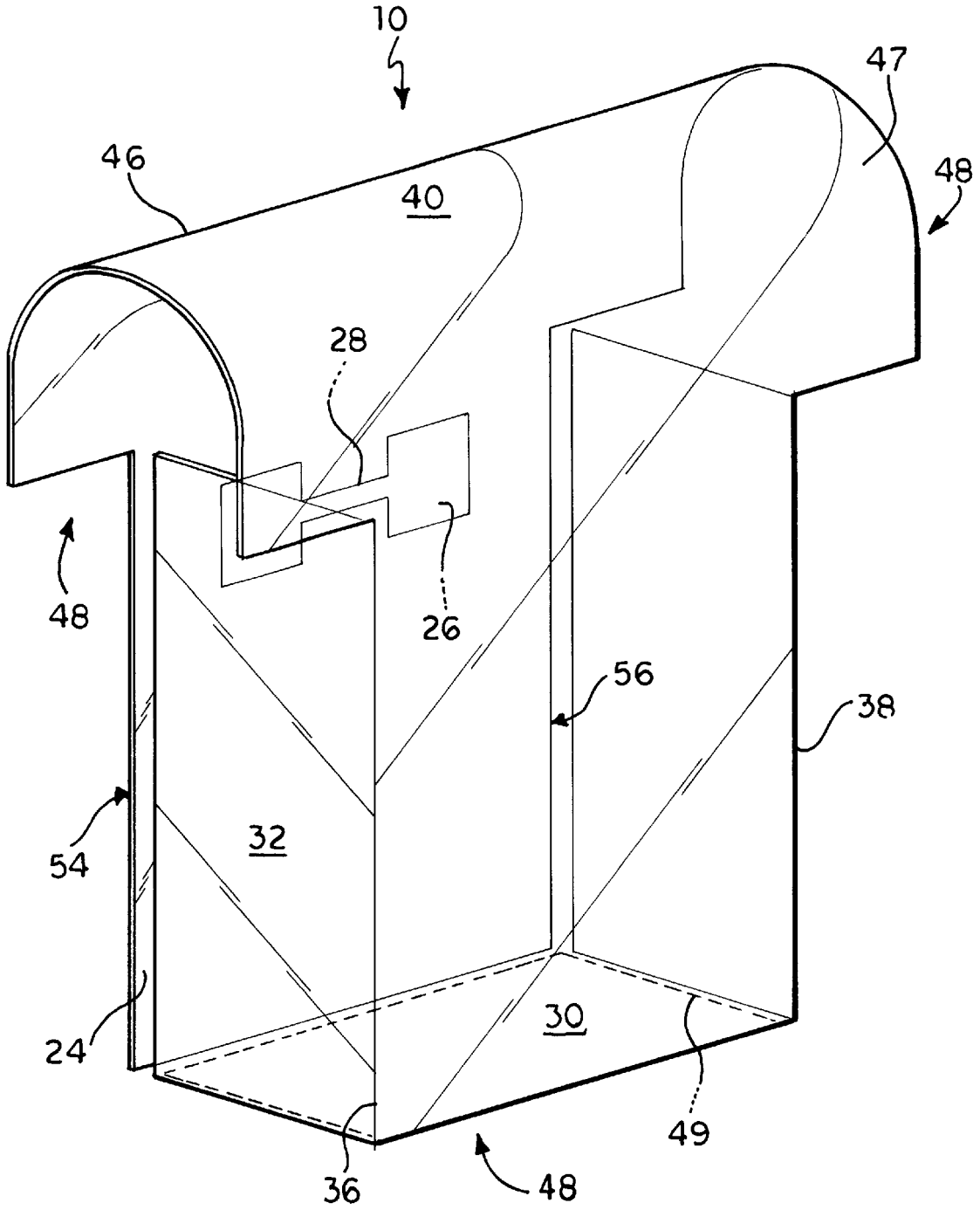
FIG. 2 is a perspective view on a larger scale of the clear padlock weather shield of FIG. 1.

FIG. 2 shows greater detail of the embodiment of the shield 10 designed for use with a hasp 14 and staple 16. In this embodiment, the shield 10 is constructed from a clear, flexible sheet material, such as acetate film or plastic. The shield 10 has a back 24, front 30, a left side 32, and a right side 34 formed into a box, covered by a roof or top 40. The sheet material is pre-molded or formed in a manner which gives the roof and box a resilient, shape-retaining memory. The back 24 is generally planar and defines a slit 26 that is intruded upon at its center by two tabs 28 dimensioned in size to fit between the legs of a staple. This configuration allows the shield 10 to be installed onto and cover a padlock 12 securing a hasp 14 to a staple 16.

The front and back panels 24,30 are generally congruent rectangles connected by a curvilinear top or roof which also functions as a living hinge. When installed as pictured in FIG. 1, the top 40 is concave toward the ground and convex toward the sky. The left side 32 is connected to the front 30 at a ninety degree angle along a left fold line 36 and the right side 34 is similarly connected to the front 30 along a right fold line 38. The left fold line 36 also represents a left edge of the front 30 and the right fold line 38 also represents a right edge of the front 30. The front 30 is connected to the back 24 by top 40.

The top further defines a left awning 46 which overhangs the left side 32. Likewise, a right awning 47 overhangs the right side 34. These awnings 46,47 define an open breathing space 48 above the left side 32 and the right side 34, and below the top 40. Another breathing space 48 is defined at the bottom of the shield 10 by the bottoms of the front 30, the left side 32, and the right side 34.

In use, the staple 16 is passed through the slit 26 so that the back 24 sits flush against the surface upon which the staple 16 is fixedly mounted. While the back 24 is forced over the staple 16, the tabs 28, extending toward each other to nearly meet, resiliently spring into place after being snapped over the staple 16. The next step in installation is to secure the device 10 by closing the hasp 14 over the staple 16. This step takes place while clearing the front 30, left side 32, and right side 34 from in front of the staple by virtue of the living hinge, i.e. roof 40. Thus, the back 24 rests flush between the hasp 14 and the surface to which the hasp 14 is fixedly mounted.

After the hasp 14 has been rotated over the staple 16, the padlock 12 may be secured to the staple 16. Once the padlock 12 is secured to the staple 16, the front and side panels are allowed to drop into place to form the final resting state of shield 10, as pictured in FIG. 2. The shield thus becomes loosely secured to the hasp and staple.

The breathing spaces 48 created by the awnings permit ambient air to flow into the shield 10. This air flow allows a minimum of wear and tear on the shield 10 to occur from the expansion and contraction of the material of the shield 10 in response to temperature differences that would otherwise be present between the inside of the shield 10 and outside the shield 10, as might occur through greenhouse effects.

In an alternative embodiment, a solid bottom 49 (shown in broken lines in FIG. 2) is formed along a fold line at the bottom of the front 30. In this alternative embodiment, the bottom rests flush against, but not connected to, the back 24 at a ninety degree angle to the front 30, just as the left side 32 and right side 34 are connected to the front 30 but not connected to the back 24 in the pictured embodiment. The breathing spaces 48 under the awnings 46,47 are kept open in this alternative embodiment.

Figure 4:
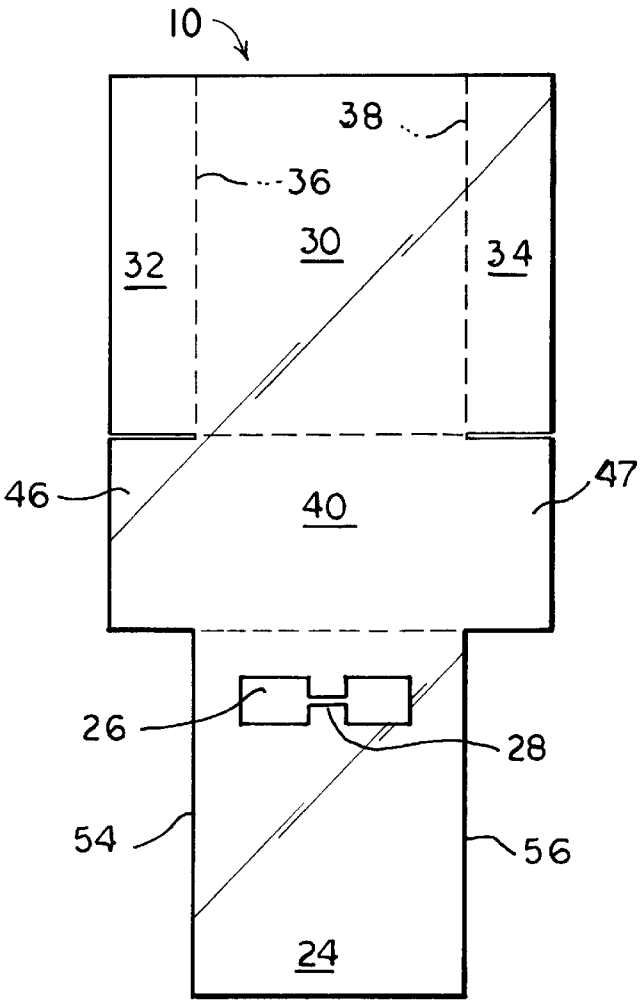
FIG. 4 is a flat plan view of the embodiment of the padlock weather shield, prior to molding or forming, for use with a hasp and staple.

FIG. 4 illustrates the shield 10 as a patterned sheet completely flattened prior to molding and installation. A front fold line 42 and a back fold line 44 are also shown to demarcate the ends of curvature of the top 40 when installed. For the purpose of clarity, FIG. 4 also shows a left outer edge 54 and a right outer edge 56 of the back 24. All folds and curves may either be pre-formed or hand formed by the user.

The curvilinear shape to the top 40 prevents precipitation from settling on the top 40 above the padlock 12 by causing the precipitation to roll off of the top 40 to the ground. Unlike the present functional design, a simple design such as a flat top would permit snow and ice to build up on the top of a similar shield, it being undesirable to allow precipitation to gather on the top 40 of a shield 10. In such a design, ice may build up making it difficult to lift the front and expose a padlock. Additionally, when piled snow melts from the top, other designs would allow the liquid to leak into the interior of the shield. This is particularly true where there is any sort of seam between a top and the front, back or sides of a shield. Such leakage of liquid would come in contact with the padlock, effectively obviating the purpose for which the shield was designed.

Further, over time, build up of ice, snow, and other forms of solid precipitation on the top of a shield 10 would cause the top to bow inwardly developing a contour that is concave toward the sky. After developing such a contour, the top of the shield would also retain water during rain. Cumulatively, these deleterious effects resulting from a design that permits the build up of precipitation on the top of a shield mitigate strongly against any benefits of such a design. The curvilinear top 40 shown is superior to any alternative design not only in its contour, but also in its seamless connection to the front 30 and the back 24, and in its awnings 46,47 overhanging the left side 32 and the right side 34. All of these features provide superior protection from the elements.

Figure 3:
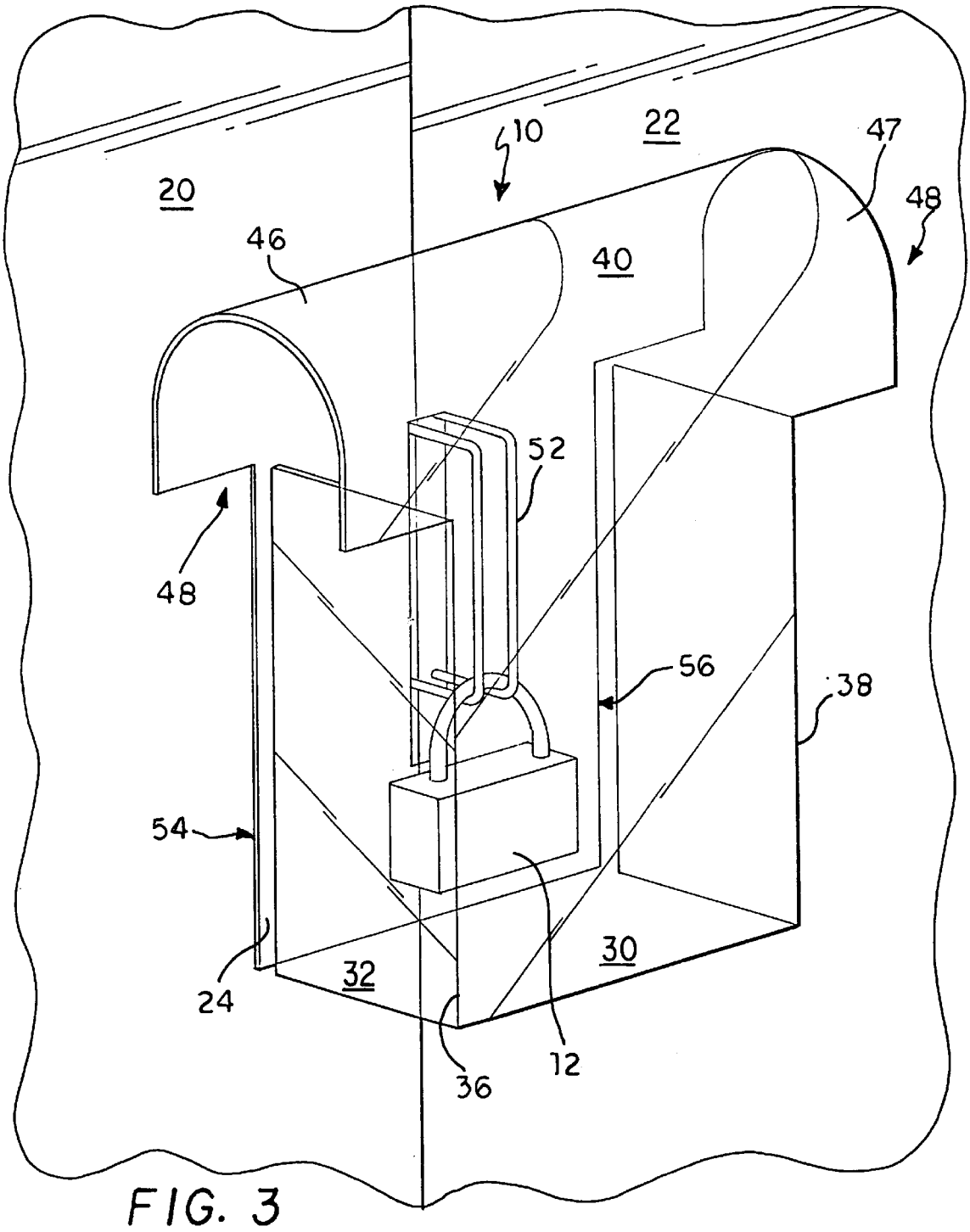
FIG. 3 is an environmental, perspective view of a second embodiment of a clear padlock weather shield in use with a sliding double door and padlock installation.

Referring again to FIG. 1, the hasp 14 is fixedly attached to a left door 20, and the staple is fixedly attached to a right door 22. The left door 20 and the right door 22 are rotatably attached to the front of the shed 18 by hinges (not shown). Thus, when the shed 18 is open, the doors 20,22 are rotated outwardly. However, other types of doors slide laterally. FIG. 3 thus shows a second embodiment of the shield 10 designed for use with sliding doors having vertically oriented handles. Generally, when sliding doors are used, the left door 20 and the right door 22 each have a handle 52 rather than the hasp 14 and the staple 16. The padlock 12 is shown secured to both of the handles 52.

Figure 5:
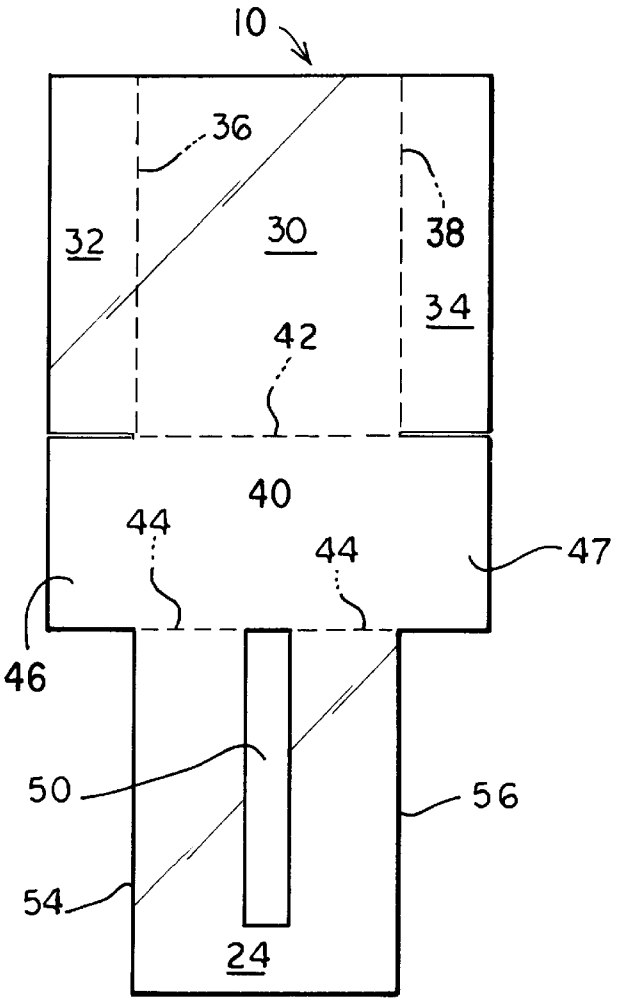
FIG. 5 is a flat plan view of the second embodiment of the padlock weather shield and padlock, prior to molding or forming, for use with a sliding double door.

The second embodiment of the shield 10 is identical to the embodiment of the shield 10 described above in every aspect except that the second embodiment does not have the slit 26 or the tabs 28 in the back 24. Instead of the slit 26 with the tabs 28, this embodiment of the shield 10 has a long slot 50 configured to receive the pair of handles. FIG. 5 shows additional detail of the slot 50 with this embodiment of the shield 10 completely flat prior to installation or molding. The slot 50 is oriented longitudinally, from roof 40 to bottom of rear panel 24, instead of transversely as is slit 26. It should be apparent that the installation procedure for this embodiment is nearly identical to the installation procedure described above, except that the handles 52 are together slipped through slot 50, instead of inserting a staple through slit 26.

A clear or transparent material is preferably selected for the embodiments of the shield 10 shown in the Figures. Similarly, a clear material serves the purpose of allowing a visual inspection of the inside of the shield 10 without manually manipulating the shield 10. However, alternative embodiments may use the same material pigmented by a predetermined color as desired.

The material used to construct the shield 10 must be flexible and resilient so as to properly form both the curvilinear top 40 and the responsive tabs 28, as described above. The material used to construct the shield 10 must also have a memory so as to hold the left side 32 and the right side 34 at a ninety degree angle to the front 30. For many materials, gravity will be sufficient to overcome any memory in the material in order to maintain the contour of the top 40. To whatever extent necessary, depending on the material selected, the shield is pre-molded along the fold lines 36,38 and 42,44. The material should be sufficiently thick or strong so as to hold its shape. Any material known in the art capable of meeting these specifications is acceptable.

The shield 10 may be cut into a range of predetermined sizes. A larger size shield is used for locks on doors on outdoor buildings, and a smaller size shield is used for smaller storage locker locks.

Figure 6:
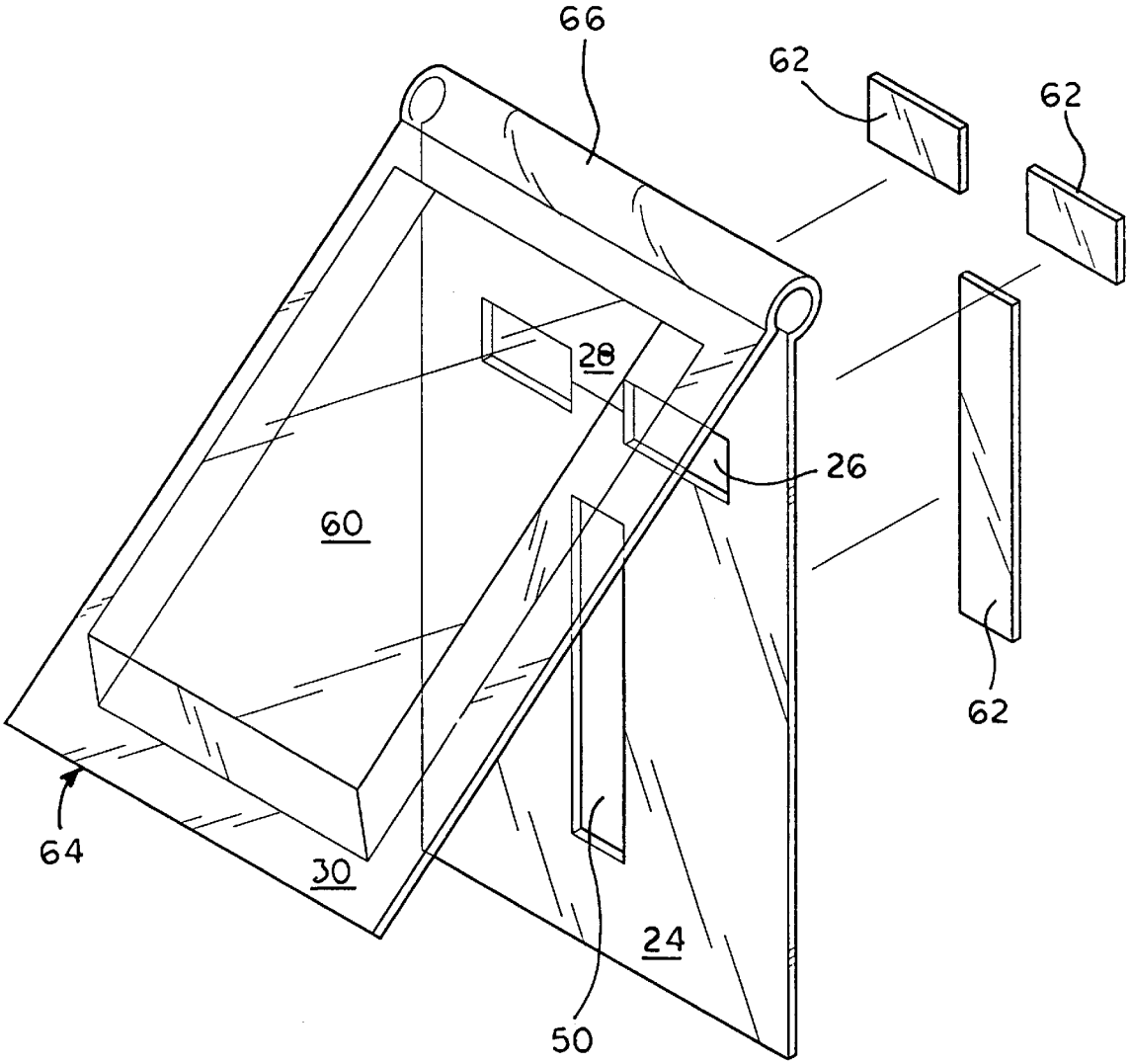
FIG. 6 is a perspective view of the padlock weather shield that permits use as sales packaging.

A third embodiment of the padlock weather shield is shown in FIG. 6. This embodiment may serve double duty as both sales packaging and a weather shield. The shield is comprised of a back 24, a front 30, and a living hinge 66 connecting the two. Again, the weather shield is formed from a continuous sheet of resilient material. The back 24 of this embodiment, however, is provided with perforated sections 62 which can be removed by the consumer, as necessary. The perforations correspond to two slots 26,50 for accepting various locking hardware, such as the hasp and staple or handles. The front 30 of the shield has a raised area 60 which defines a cavity. At its upper portion, the raised area defines a sloped top which prevents the collection of precipitation. The raised area 60 is bounded by on all sides by a flange 64. At the top, the front 30 is joined to the back 24 by a living hinge 66. The living hinge 66 is merely a continuation of the resilient material of the front 30 and back 24 that is capable of flexing without breaking. As packaging, the shield is left intact leaving perforated sections 62 for removal by the consumer. A lock is placed in the cavity defined by the raised area 60 of the front 30. The flanges 64 of the front are then removably attached by any known attachment means (including releasable adhesives, snap-fittings, etc.) to the perimeter of the back 24. In this manner, the lock is presented for sale.

Once the consumer purchases the lock, the packaging is saved for use as a weather shield. The front edges 64 are detached from the back 30, except along the living hinge 66. The desired perforated sections 62 are then removed for accepting locking hardware, and the shield installed over that hardware. The lock may then be applied. Finally, the front 30 is closed, and the lock is protected from the weather by the shield. As in the other embodiments, the shield is preferably made out of a transparent sheet material.

It is to be understood that the present invention is not limited to the embodiments described above, but encompasses any and all embodiments within the scope of the following claims.

I claim:

1. A padlock weather shield comprising:

a continuous, seamless article of flexible resilient material having a memory, said article defining:

a. a substantially planar back defining a slot for accepting various locking hardware;

b. a curvilinear top, having its concavity facing downward, which extends from an upper portion of said back, wherein said top functions as a living hinge;

c. a pair of awnings each being a lateral extension of said curvilinear top such that said awnings overhang left and right planar sides;

d. a substantially planar front extending downward from said top;

e. said left and right planar sides extending from opposite sides of said front at right angles thereto and extending toward said back;

wherein said front, back, and sides define a chamber in which a lock may be placed, protected from the elements while being accessible by lifting said front.

2. The padlock weather shield as defined in claim 1 wherein said front and said back are substantially congruent rectangles.

3. The padlock weather shield as defined in claim 1 wherein said slot is designed to receive therethrough in close-fit relation a staple, designed to mate with a corresponding hasp, said padlock weather shield further comprising a pair of opposing tabs bisecting said slot for securely engaging the staple.

4. The padlock weather shield as defined in claim 1 wherein the slot is shaped to receive a handle.

5. The padlock weather shield as defined in claim 1 wherein the flexible resilient material is substantially transparent.

6. The padlock weather shield as defined in claim 1 wherein the flexible resilient material is colored.

7. A padlock weather shield comprising:

a. a planar back having perforation lines defining a plurality of sections each of which when removed defines a slot; wherein;

i. one of said slots is shaped to receive therethrough in close-fit relation a staple, which mates with a corresponding hasp, said padlock weather shield further comprising a pair of opposing tabs bisecting said slot for securely engaging the staple; and ii. a remaining slot is shaped to receive a handle;

b. a substantially planar front defining a raised central portion defining a cavity, wherein said cavity is sized to accept a pad lock; said raised central portion being bounded on all sides by flat planar edges;

c. a living hinge connecting said front to said back, such that said front, back, and living hinge are formed from a continuous sheet of resilient material; and wherein said edges of said front are detachably sealed to said back for securing a lock within said cavity for the additional purpose of sales display.

8. The padlock weather shield as defined in claim 7 wherein said front and said back are substantially congruent rectangles.

9. The padlock weather shield as defined in claim 7 wherein the resilient material is substantially transparent.

10. The padlock weather shield as defined in claim 7 wherein the resilient material is colored.

* * * * *